United States Patent [19]

Covitch et al.

[11] Patent Number: 4,469,579

[45] Date of Patent: Sep. 4, 1984

[54] SOLID POLYMER ELECTROLYTES AND ELECTRODE BONDED WITH HYDROPHYLIC FLUOROCOPOLYMERS

[75] Inventors: Michael J. Covitch, Cleveland Heights; Donald L. DeRespiris, Mentor, both of Ohio; Leo L. Benezra, San Jose, Calif.; Elvin M. Vauss, Cleveland, Ohio

[73] Assignee: Diamond Shamrock Corporation, Dallas, Tex.

[21] Appl. No.: 419,922

[22] Filed: Sep. 20, 1982

Related U.S. Application Data

[63] Continuation-in-part of Ser. No. 277,918, Jun. 26, 1981, Pat. No. 4,421,579.

[51] Int. Cl.[3] ..... C25B 1/46; C25B 9/04

[52] U.S. Cl. ..... 204/283; 204/296; 429/41; 429/42

[58] Field of Search ..... 204/282, 283, 290 R, 204/291, 292, 296, 295; 429/41, 42

[56] References Cited

U.S. PATENT DOCUMENTS

| | | | |
|---|---|---|---|
| 4,090,931 | 9/1978 | Motani et al. | 204/98 |
| 4,191,616 | 4/1980 | Coker | 204/291 |
| 4,196,070 | 4/1980 | Chao et al. | 204/252 |
| 4,287,032 | 9/1981 | Pellegri | 204/128 |

*Primary Examiner*—John F. Niebling

*Attorney, Agent, or Firm*—Woodrow W. Ban; John J. Freer

[57] ABSTRACT

A solid polymer electrolyte (SPE), solid polymer electrolyte electrode, and method for forming from cationic exchange perfluorocarbon copolymer. Disclosed are solution techniques for forming SPE's and SPE electrodes using fluorocarbon vinyl ether copolymers.

2 Claims, 1 Drawing Figure

SOLID POLYMER ELECTROLYTES AND ELECTRODE BONDED WITH HYDROPHYLIC FLUOROCOPOLYMERS

CROSS REFERENCE TO RELATED APPLICATION

This is a continuation-in-part application of U.S. patent application Ser. No. 277,918 filed June 26, 1981 now U.S. Pat. No. 4,421,579.

FIELD OF THE INVENTION

This invention relates to batteries, fuel cells and electrochemical cells, and more particularly to copolymeric perfluorocarbon structures utilized in such cells. More specifically, this invention relates to solid polymeric electrolytes and solid polymer electrolyte electrodes and cell structures and to methods for fabricating solid polymer electrolytes and solid polymer electrolyte electrodes and for attaching these electrodes to copolymeric perfluorocarbon membranes for use in electrochemical cells.

BACKGROUND OF THE INVENTION

The use of a separator between an anode and cathode in batteries, fuel cells, and electrochemical cells is known. In the past, these separators have been generally porous separators, such as asbestos diaphragms, used to separate reacting chemistry within the cell. Particularly, for example, in diaphragm chlorine generating cells, such a separator functions to restrain back migration of $OH^-$ radicals from a cell compartment containing the cathode to a cell compartment containing the anode. A restriction upon $OH^-$ back migration has been found to significantly decrease overall electric current utilization inefficiencies in operation of the cells associated with a reaction of the $OH^-$ radical at the anode releasing oxygen.

More recently separators based upon an ion exchange polymer have found increasing application in batteries, fuel cells, and electrochemical cells. One copolymeric ion exchange material finding particular acceptance in electrochemical cells such as chlorine generation cells has been fluorocarbon vinyl ether copolymers known generally as perfluorocarbons and marketed by E. I. duPont under the name Nafion®.

These so-called perfluorocarbons are generally copolymers of two monomers with one monomer being selected from a group including vinyl fluoride, hexafluoropropylene, vinylidene fluoride, trifluoroethylene, chlorotrifluoroethylene, perfluoro(alkylvinyl ether), tetrafluoroethylene and mixtures thereof.

The second monomer is selected from a group of monomers usually containing an $SO_2F$ or sulfonyl fluoride group. Examples of such second monomers can be generically represented by the formula $CF_2{=}CFR_1SO_2F$. $R_1$ in the generic formula is a bifunctional perfluorinated radical comprising 1 to 8 carbon atoms but occasionally as many as 25 carbon atoms. One restraint upon the generic formula is a general requirement for the presence of at least one fluorine atom on the carbon atom adjacent the $-SO_2F$, particularly where the functional group exists as the $-(-SO_2NH)mQ$ form. In this form, Q can be hydrogen or an alkali or alkaline earth metal cation and m is the valence of Q. The $R_1$ generic formula portion can be of any suitable or conventional configuration, but it has been found preferably that the vinyl radical comonomer join the $R_1$ group through an ether linkage.

Typical sulfonyl fluoride containing monomers are set forth in U.S. Pat. Nos. 3,282,875; 3,041,317; 3,560,568; 3,718,627 and methods of preparation of intermediate perfluorocarbon copolymers are set forth in U.S. Pat. Nos. 3,041,317; 2,393,967; 2,559,752 and 2,593,583. These perfluorocarbons generally have pendant $SO_2F$ based functional groups.

Chlorine cells equipped with separators fabricated from perfluorocarbon copolymers have been utilized to produce a somewhat concentrated caustic product containing quite low residual salt levels. Perfluorocarbon copolymers containing perfluoro(3,6-dioxa-4-methyl-7-octenesulfonyl fluoride) comonomer have found particular acceptance in $Cl_2$ cells.

In chlorine cells using a sodium chloride brine feedstock, one drawback to the use of perfluorocarbon separators having pendant sulfonyl fluoride based functional groups has been a relatively low resistance in desirably thin separators to back migration of caustic including $OH^-$ radicals from the cathode to the anode compartment. This back migration contributes to a lower current utilization efficiency in operating the cell since the $OH^-$ radicals react at the anode to produce oxygen. Recently, it has been found that if pendant sulfonyl fluoride based cationic exchange groups adjacent one separator surface were converted to pendant carboxylate groups, the back migration of $OH^-$ radicals in such $Cl_2$ cells would be significantly reduced. Conversion of sulfonyl fluoride groups to carboxylate groups is discussed in U.S. Pat. No. 4,151,053.

Presently, perfluorocarbon separators are generally fabricated by forming a thin membrane-like sheet under heat and pressure from one of the intermediate copolymers previously described. The ionic exchange capability of the copolymeric membrane is then activated by saponification with a suitable or conventional compound such as a strong caustic. Generally, such membranes are between 0.5 mil and 150 mil in thickness. Reinforced perfluorocarbon membranes have been fabricated, for example, as shown in U.S. Pat. No. 3,925,135.

Notwithstanding the use of such membrane separators, a remaining electrical power inefficiency in many batteries, fuel cells and electrochemical cells has been associated with a voltage drop between the cell anode and cathode attributable to passage of the electrical current through one or more electrolytes separating these electrodes remotely positioned on opposite sides of the cell separator.

Recent proposals have physically sandwiched a perfluorocarbon membrane between an anode-cathode pair. The membrane in such sandwich cell construction functions as an electrolyte between the anode-cathode pair, and the term solid polymer electrolyte (SPE) cell has come to be associated with such cells, the membrane being a solid polymer electrolyte. In some of these SPE proposals, one or more of the electrodes has been a composite of a fluororesin polymer such as Teflon®, E. I. duPont polytetrafluoroethylene (PTFE), with a finely divided electrocatalytic anode material or a finely divided cathode material. In others, the SPE is sandwiched between two such polymeric electrodes. Typical sandwich SPE cells are described in U.S. Pat. Nos. 4,144,301; 4,057,479; 4,056,452 and 4,039,409. SPE composite electrode cells are described in U.S. Pat. Nos. 3,297,484; 4,212,714 and 4,214,958 and in Great Britain Patent Application Nos. 2,009,788A; 2,009,792A and 2,009,795A.

Use of the composite electrodes can significantly enhance cell electrical power efficiency. However, drawbacks associated with present composite electrode configurations have complicated realization of full efficiency benefits. Composite electrodes generally are formed from blends of particulate PTFE TEFLON and a metal particulate or particulate electrocatalytic compound. The PTFE blend is generally sintered into a decal-like patch that is then applied to a perfluorocarbon membrane. Heat and pressure are applied to the decal and membrane to obtain coadherence between them. A heating process generating heat sufficient to soften the PTFE for adherence to the sheet can present a risk of heat damage to cationic exchange properties of the membrane.

These PTFE TEFLON based composites demonstrate significant hydrophobic properties that can inhibit the rate of transfer of cell chemistry through the composite to and from the electrically active component of the composite. Therefore, TEFLON content of such electrodes must be limited. Formation of a porous composite has been proposed to ameliorate the generally hydrophobic nature of the PTFE composite electrodes, but simple porosity has not been sufficient to provide results potentially available when using a hydrophyllic polymer in constructing the composite electrode.

To date efforts to utilize a hydrophyllic polymer such as NAFION have been largely discouraged by difficulty in forming a commercially acceptable composite electrode utilizing NAFION. While presently composites are formed by sintering particles of PTFE TEFLON until the particles coadhere, it has been found that similar sintering of NAFION can significantly dilute the desirable cationic exchange performance characteristics of NAFION polymer in resulting composite electrodes.

An analogous difficulty has surfaced in the preparation of SPE sandwiches employing more conventional electrode structures. Generally these sandwich SPE electrode assemblies have been prepared by pressing a generally rectilinear electrode into one surface of a NAFION membrane. In some instances, a second similar electrode is simultaneously or subsequently pressed into the obverse membrane surface. To avoid heat damage to the NAFION membrane, considerable pressure, often as high as 6000 psi is required to embed the electrode firmly in the membrane. Depending upon the configuration of the embedded electrode material, such pressure is often required to be applied simultaneously over the entire electrode area, requiring a press of considerable proportions when preparing a commercial scale SPE electrode.

Often where a foraminous electrode such as a mesh of titanium coated with a chlorine release electrocatalyst or a nickel mesh contacts a membrane in a cell, gases released at the electrode adhere to portions of the membrane causing a blinding effect thereby restricting cation passage therethrough. This restriction elevates the electrical voltage required for cell operation, and thereby effectively increases operational power costs.

The use of alcohols to solvate particularly low equivalent weight perfluorocarbon copolymers is known. However, as yet, proposals for formation of perfluorocarbon composite electrodes and for solvent welding the composites to perfluorocarbon membranes where the perfluorocarbons are of relatively elevated equivalent weights desirable in, for example, chlorine cells, have not proven satisfactory. Dissatisfaction has been at least partly due to a lack of suitable techniques for dispersing or solvating in part these higher equivalent weight perfluorocarbons.

DISCLOSURE OF THE INVENTION

The present invention provides improved solid polymer electrolyte (SPE) and SPE electrode assemblies and a method for making the assemblies. The SPE assembly of the instant invention includes a cell separator or membrane and at least one solid polymer electrolyte. The solid polymer electrolyte may also function as an electrode, being a composite of a copolymeric perfluorocarbon and an electrocatalytic substance. The membrane and the copolymeric portion of any such solid polymer electrolyte or electrode composite are comprised principally of copolymeric perfluorocarbon such as NAFION. The SPE and SPE electrode assembly of the instant invention find particular use in chlorine generation cells.

An assembly made in accordance with the instant invention includes a perfluorocarbon copolymer based ion exchange separator or membrane and one or more solid polymer electrolytes (SPE) or solid polymer electrolyte electrodes coadhered to the membrane. Coadhered SPE's can include a particulate that is non electrocatalytic forming a composite SPE. Coadhered SPE electrodes include a relatively finely divided material having desired electrode and/or electrocatalytic properties. The SPE electrode is a composite including a quantity of hydrophyllic perfluorocarbon copolymeric material at least partially coating the electrode material.

An SPE having included particulates can provide enhanced gas release properties to a membrane chlor-alkali cell. The SPE electrode is a composite of a relatively finely divided conductive electrode material or substance and the copolymeric perfluorocarbon. Generally, if functioning as an anode, such a composite electrode will comprise the copolymeric perfluorocarbon and an electrocatalytic metal oxide such as an oxide of either a platinum group metal, antimony, tin, titanium, vanadium or mixtures thereof. Where functioning as a cathode, such an electrode can be comprised of a relatively finely divided material such as carbon, a group 8 metal, a group IB metal, a group IV metal, stainless steel and mixtures thereof.

In composite electrodes including finely divided metallics providing electrochemical reaction sites, it is advantageous that pores be included generally throughout the composite to provide movement of cell electrochemical reactants to and from the reaction sites. It is desirable that finely divided metallics in such porous composite be only partially coated by the copolymeric perfluorocarbon.

SPE and SPE electrode assemblies of the instant invention are prepared by providing a perfluorocarbon copolymeric membrane and coadhering at least one composite SPE or SPE electrode to the membrane. Where more than one membrane surface is to have a coadhered SPE or SPE electrode, a composite anode of a conductive anode material and copolymeric perfluorocarbon may be attached to one membrane surface, for example, and a composite cathode of a conductive cathode material and copolymeric perfluorocarbon may be attached to the obverse membrane surface.

SPE or SPE electrode composites can be prepared and coadhered to a selected membrane by any of several interrelated methods. For composites including relatively finely divided material, copolymeric perfluorocarbon is dispersed in a solvating dispersion media, and the finely divided material is blended with the dispersion and deposited in the form of a composite. Dispersion media is removed, and the composite is coadhered to one surface of the membrane. Alternately the dispersion and at least partially dispersion coated finely divided material are applied directly upon one surface of the membrane in the form of a composite, and the dispersion media is removed. Dispersion media removal and coadherence of the composite to the membrane can be enhanced by the timely application of heat and pressure or by a leaching procedure involving a second substance in which the dispersion media is substantially miscible.

Where relatively finely divided metallic electrode material is employed in an electrode composite, it is much preferred that the composite be rendered porous. Composite porosity can be attained by including a pore precursor in preparing the copolymeric perfluorocarbon dispersion and then removing the pore precursor, such as by chemical leaching, after the dispersion media has been removed from the composite electrode. Alternately the porosity can be accomplished by depositing dispersion containing crystallized dispersion media droplets, subsequently removed.

It is preferable, where employing relatively finely divided metallic electrode material, to at least partially coat the material by dispersing it while dispersing the copolymeric perfluorocarbon and any pore precursor.

The above and other features and advantages of the invention will become apparent from the following detailed description of the invention made with reference to the accompanying drawing which together form a part of the specification.

BEST MODE FOR CARRYING OUT THE INVENTION

Figure 1:
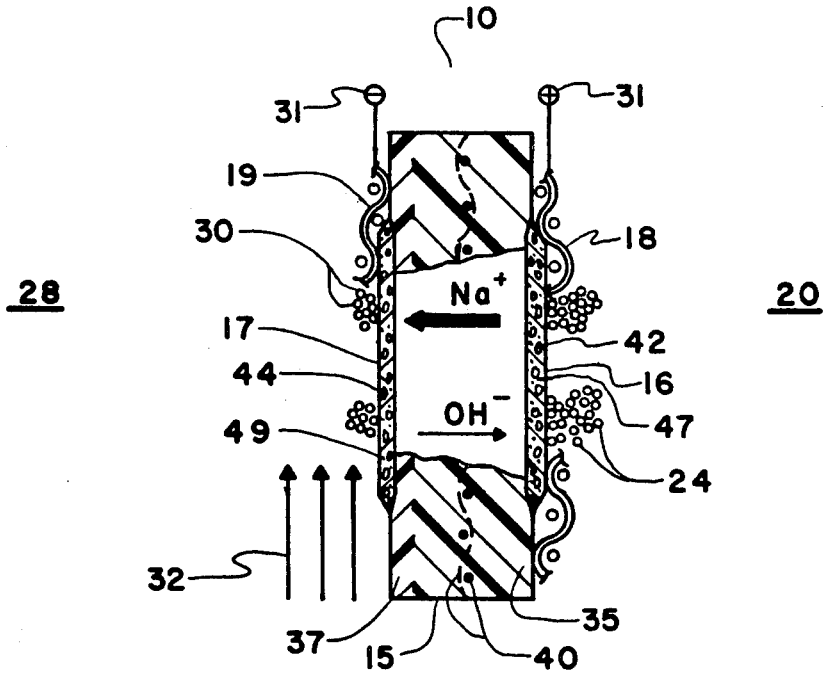
FIG. 1 is a side elevational cross-sectional view of a solid polymer electrolyte electrode assembly shown in an environment typical of application to chlorine manufacture from sodium chloride brine.

Referring to FIG. 1, a solid polymer electrolyte electrode assembly is shown generally at 10. The solid polymer electrolyte (SPE) electrode assembly 10 is comprised of a membrane or separator 15, composite electrodes comprising an anode 16, and a cathode 17, and current collectors 18, 19.

The electrode assembly 10 functions within the confines of any suitable or conventional cell (not shown) to disassociate sodium chloride brine present in the cell generally at 20. The sodium chloride reacts generally at the anode 16 to release chlorine gas bubbles 24 which rise from the cell and are removed in any suitable or conventional manner well-known to those skilled in the art. Sodium ions released in the same reaction negotiate the separator 15 to carry electrical current between the anode and the cathode 17. At the cathode, water present in the cell generally at 28 reacts to release hydrogen gas 30 and hydroxyl ions. These hydroxyl ions react with the sodium ions present at the cathode 17 to produce sodium hydroxide, or caustic. The caustic generally migrates to the cell area 28 while the hydrogen bubbles 30 rise from the cell and are recovered in any suitable or conventional manner. There is a tendency for caustic and/or hydroxyl ions to counter migrate from the cathode 17 to the anode 16 through the separator 15. Any hydroxyl ions reaching the anode tend to react to produce oxygen, and any such oxygen reaction decreases the overall electrical current efficiency in operation of the cell. A source 31 of electrical current impresses a current between the anode 16 and the cathode 17 motivating the cell reactions.

The generally sheet-like separator 15 is comprised principally of copolymeric perfluorocarbon such as NAFION. The perfluorocarbon desirably should be available as an intermediate copolymer precursor which can be readily converted to a copolymer containing ion exchange sites. However, the perfluorocarbon is more generally available in sheets already converted to provide active ion exchange sites. These sites on the final copolymer provide the ion exchange functional utility of the perfluorocarbon copolymer in the separator 15.

The intermediate polymer is prepared from at least two monomers that include fluorine substituted sites. At least one of the monomers comes from a group that comprises vinyl fluoride, hexafluoropropylene, vinylidene fluoride, trifluoroethylene, chlorotrifluoroethylene, perfluoro(alkyl vinyl ether), tetrafluoroethylene and mixtures thereof.

At least one of the monomers comes from a grouping having members with functional groups capable of imparting cationic exchange characteristics to the final copolymer. Monomers containing pendant sulfonyl, carbonyl or, in some cases phosphoric acid based functional groups are typical examples. Condensation esters, amides or salts based upon the same functional groups can also be utilized. Additionally, these second group monomers can include a functional group into which an ion exchange group can be readily introduced and would thereby include oxyacids, salts, or condensation esters of carbon, nitrogen, silicon, phosphorus, sulfur, chlorine, arsenic, selenium, or tellurium.

Among the preferred families of monomers in the second grouping are sulfonyl containing monomers containing the precursor functional group $SO_2F$ or $SO_3$ alkyl. Examples of members of such a family can be represented by the generic formula of $CF_2{=}CFSO_2F$ and $CF_2{=}CFR_1SO_2F$ where $R_1$ is a bifunctional perfluorinated radical comprising usually 2 to 8 carbon atoms but reaching 25 carbon atoms upon occasion.

The particular chemical content or structure of the perfluorinated radical linking the sulfonyl group to the copolymer chain is not critical and may have fluorine, chlorine or hydrogen atoms attached to the carbon atom to which the sulfonyl group is attached, although the carbon atom to which the sulfonyl group is attached must also have at least one fluorine atom attached. Preferably the monomers are perfluorinated. If the sulfonyl group is attached directly to the chain, the carbon is the chain to which it is attached must have a fluorine atom attached to it. The $R_1$ radical of the formula above can be either branched or unbranched, i.e., straight chained, and can have one or more ether linkages. It is preferred that the vinyl radical in this group of sulfonyl fluoride containing comonomers be joined to the $R_1$ group through an ether linkage, i.e., that the comonomer be of the formula $CF_2{=}CFOR_1SO_2F$. Illustrative of such sulfonyl fluoride containing comonomers are:

$CF_2{=}CFOCF_2CF_2SO_2F$, $CF_2{=}CFOCF_2\underset{\underset{CF_3}{|}}{C}FOCF_2CF_2SO_2F$, $CF_2{=}CFOCF_2\underset{\underset{CF_3}{|}}{C}FOCF_2\underset{\underset{CF_3}{|}}{C}F_2SO_2F$, $CF_2{=}CFCF_2CF_2SO_2F$, and $$CF_2{=}CFOCF_2\underset{\underset{\underset{\underset{CF_3}{|}}{O}}{\underset{CF_2}{|}}}{C}FOCF_2CF_2SO_2F$$

The corresponding esters of the aforementioned sulfonyl fluorides are equally preferred.

While the preferred intermediate copolymers are perfluorocarbon, that is perfluorinated, others can be utilized where there is a fluorine atom attached to the carbon atom to which the sulfonyl group is attached. A highly preferred copolymer is one of tetrafluoroethylene and perfluoro(3,6-dioxa-4-methyl-7-octenesulfonyl fluoride) comprising between 10 and 60 weight percent, and preferably between 25 and 40 weight percent, of the latter monomers.

These perfluorinated copolymers may be prepared in any of a number of well-known manners such as is shown and described in U.S. Pat. Nos. 3,041,317; 2,393,967; 2,559,752 and 2,593,583.

An intermediate copolymer is readily transformed into a copolymer containing ion exchange sites by conversion of the sulfonyl groups ($-SO_2F$ or $-SO_3$ alkyl) to the form $-SO_3Z$ by saponification or the like wherein Z is hydrogen, an alkali metal, a quaternary ammonium ion, of an alkaline earth metal. The converted copolymer contains sulfonyl group based ion exchange sites contained in side chains of the copolymer and attached to carbon atoms having at least one attached fluorine atom. Not all sulfonyl groups within the intermediate copolymer need be converted. The conversion may be accomplished in any suitable or customary manner such as is shown in U.S. Pat. Nos. 3,770,547 and 3,784,399.

A separator 15 made from copolymeric perfluorocarbon having sulfonyl based cation exchange functional groups possesses a relatively low resistance to back migration of sodium hydroxide from the cathode 17 to the anode 16, although such a membrane successfully resists back migration of other caustic compounds such as KOH. A pattern 32 of fluid circulation in the cell zone 28 adjacent the cathode contributes to a dilution in concentration of sodium hydroxide within and adjacent to the cathode and adjacent the membrane, thus reducing a concentration gradient driving force tending to contribute to sodium hydroxide back migration.

In the best mode for carrying out the invention, the separator includes a zone 35 having copolymeric perfluorocarbon containing pendant sulfonyl based ion exchange functional groups and a second zone 37 having copolymeric perfluorocarbon containing pendant carbonyl based functional ion exchange groups. The pendant carbonyl based groups provide the copolymeric perfluorocarbon with significantly greater resistance to the backmigration of sodium hydroxide, but can also substantially reduce the rate of migration of sodium ions from the anode to the cathode. In order to present a relatively small additional resistance to the desired migration of sodium ions, the carbonyl based zone 37, usually is provided to be only of sufficient dimension to produce a significant effect upon the back migration of sodium hydroxide.

Alternately zone 37 can contain perfluorocarbon containing sulfonamide functionality of the form $-R_1-SO_2NHR_2$ where $R_2$ can be hydrogen, alkyl, substituted alkyl, aromatic or cyclic hydrocarbon. Methods for providing sulfonamide based ion exchange membranes are shown in U.S. Pat. Nos. 3,969,285 and 4,113,585.

Copolymeric perfluorocarbon having pendant carboxylate cationic exchange functional groups can be prepared in any suitable or conventional manner such as in accordance with U.S. Pat. No. 4,151,053 or Japanese Patent Application 52(1977)38486 or polymerized from a carbonyl functional group containing monomer derived from a sulfonyl group containing monomer by a method such as is shown in U.S. Pat. No. 4,151,053. Preferred carbonyl containing monomers include $CF_2{=}CF{-}O{-}CF_2CF(CF_3)O(CF_2)_2\ COOCH_3$ and $CF_2{=}CF{-}O{-}CF_2CF(CF_3)OCF_2COOCH_3$.

Preferred copolymeric perfluorocarbons utilized in the instant invention therefore include carbonyl and/or sulfonyl based groups represented by the formula $-OCF_2CF_2X$ and/or $-OCF_2CF_2Y{-}O{-}YCF_2CF_2O-$ wherein X is sulfonyl fluoride ($SO_2F$) carbonyl fluoride (COF) sulfonate methyl ester ($SO_2OCH_3$) carboxylate methyl ester ($COOCH_3$) ionic carboxylate ($COO^-Z^+$) or ionic sulfonate ($SO_3^-Z^+$), Y is sulfonyl or carbonyl ($-SO_2$——$CO-$) and Z is hydrogen, an alkali metal such as lithium, cesium, rubidium, potassium and sodium, and alkaline earth metal such as beryllium, magnesium, calcium, strontium, barium and radium, or a quaternary ammonium ion.

Generally, sulfonyl, carbonyl, sulfonate and carboxylate esters and sulfonyl and carbonyl based amide forms of the perfluorocarbon copolymer are readily converted to a salt form by treatment with a strong alkali such as NaOH.

The zone 37 where used in a cell having foraminous electrodes in lieu of SPE electrodes can contain a particulate such as an oxide of a valve metal. Particularly the oxides of titanium and zirconium have been found to aide in release from the surface of the zone of gases being evolved from the foraminous electrode, particularly where that foraminous electrode is situated in close proximity to the membrane or contacts the membrane directly. Gas release functions to "unblind" membrane surface, thus reducing restriction to the flow of cations through the membrane. The zone 37 thereby functions as an SPE between the electrode and the remaining membrane material, this SPE containing a non-electrolytic particulate.

An SPE or SPE electrode assembly is made in accordance with the instant invention by first providing a copolymeric perfluorocarbon membrane 15. The membrane 15 can include members of one or more of the ion exchange functional groups discussed previously, depending upon the nature of chemical reactants in the electrochemical cell. Blending of polymers containing different ion exchange functional groups is an available alternate. When chlorine is to be generated from sodium chloride brine, it has been found advantageous to employ copolymer containing pendant sulfonyl based groups throughout most of the membrane and a similar copolymer, but containing pendant carbonyl based groups adjacent what is to be the cathode 17 facing membrane surface which can be attached as an SPE in accordance herewith.

The membrane 15 can be formed by any suitable or conventional means such as by extrusion, calendering, solution coating or the like. It may be advantageous to employ a reinforcing framework 40 within the copolymeric material. This framework can be of any suitable or conventional nature such as TEFLON mesh or the like. Layers of copolymer containing differing pendant functional groups can be laminated under heat and pressure is well-known processes to produce a membrane having desired functional group properties at each membrane surface. Alternatively a bifunctional group membrane can be provided in accordance with SPE forming techniques of the invention. For chlorine cells, such membranes have a thickness generally of between 1 mil and 150 mils with a preferable range of from 4 mils to 10 mils.

The equivalent weight range of the copolymer intermediate used in preparing the membrane 15 as well as any SPE or SPE electrode is important. Where lower equivalent weight intermediate copolymers are utilized, the membrane can be subject to destructive attack such as by dissolution by cell chemistry. When an excessively elevated equivalent weight copolymer intermediate is utilized, the membrane may not pass cations sufficiently readily, resulting in an inacceptably high electrical resistance in operating the cell. It has been found that copolymer intermediate equivalent weights should preferably range between about 1000 and 1500 for the sulfonyl based membrane materials and between about 900 and 1500 for the carbonyl based membrane materials.

For an SPE electrode, an electrode substance is selected for compositing with perfluorocarbon copolymers. When the resulting composite electrode is to be an anode, this substance will generally include elements or compounds having electrocatalytic properties. Particularly useful are oxides of either platinum group metals, antimony, tin, titanium, vanadium, cobalt or mixtures thereof. Also useful are platinum group metals, silver and gold. The platinum group includes platinum, palladium, rhodium, iridium, osmium, and ruthenium.

The electrocatalytic anode substance is relatively finely divided, and where relatively finely divided, it may be combined with conductive extenders such as carbon or with relatively finely divided well-known valve metals such as titanium or their oxides. The valve metals, titanium, aluminum, zirconium, bismuth, tungsten, tantalum, niobium and mixtures and alloys thereof can also be used as the electrocatalyst while in their oxides.

When the composited electrode is to be a cathode, the active or conductive electrode substance is selected from a group comprising group IB metals, a group IV metals, a group 8 metal, carbon, any suitable or conventional stainless steel, the valve metals, platinum group metal oxides or mixtures thereof. Group IB metals are copper, silver and gold. Group IVA metals are tin and lead. Group 8 metals are iron, cobalt, nickel, and the platinum group metals. As with the anode, these active electrode substances are relatively finely divided.

Where the composite is to be an SPE having an entrained gas release particulate, the particulate is generally a valve metal oxide such as titanium or zirconium oxide or a suitable for conventional gas release particulate such as oxides, hydroxides, nitrates, or carbides of Ti, Zn, Nb, Ta, V, Mn, Mo, Sn, Sb, W, Bi, In, Co, Ni, Be, Al, Cr, Fe, Ga, Ge, Se, Y, Ay, Hf, Pb or Th.

By relatively finely divided what is meant is particles of a size of about 3.0 millimeters by 3.0 millimeters by 3.0 millimeters or smaller in at least one dimension. Particularly particles having at least one dimension considerably larger than the other have been found effective such as particles having dimensions of 1.0 millimeter by 1.4 millimeters by 0.025 millimeters. Also preferred are fibers having a diameter of between about 0.025 millimeter and about 1.0 millimeter and between about 1.0 millimeter and 50 millimeter in length are also suitable for use in forming the composite electrode.

Perfluorocarbon copolymer is dispersed in any suitable or conventional manner. Preferably relatively finely divided particles of the copolymer are used to form the dispersion. The particles are dispersed in a dispersion medium that preferably has significant capability for solvating the perfluorocarbon copolymer particles. A variety of solvents have been discovered for use as a dispersion medium for the perfluorocarbon copolymer; these suitable solvents are tabulated in Table I and coordinated with the copolymer pendant functional groups with which they have been found to be an effective dispersion medium. Since these dispersing solvents function effectively alone or in mixtures of more than one, the term dispersion media is used to indicate a suitable or conventional solvating dispersing agent including at least one solvating medium.

TABLE I

SOLVENT CROSS REFERENCE TO PERFLUOROCARBON COPOLYMER CONTAINING VARIOUS PENDANT FUNCTIONAL GROUPS

| | FUNCTIONAL GROUP | | | |
|---|---|---|---|---|
| SOLVENT | $SO_2F$ | $COO^-Z^+$ | COO (ester) | $SO_3^-Z^+$ |
| halocarbon oil | X | | X | |
| perfluorooctonic acid | X | | X | |
| perfluorodecanoic acid | X | | X | |
| perfluorotributylamine | X | | | |
| FC-70 available from 3M (perfluorotrialkylamine) | X | | | |
| perfluoro-1-methyldecalin | X | | | |
| decafluorobiphenyl | X | | | |
| pentafluorophenol | X | | | |
| pentaflurorobenzoic acid | X | | | |
| N—butylacetamide | | X | | X |
| tetrahydrothiophene-1,1-dioxide (tetramethylene sulfone Sulfolane ®) | | | | X |
| N,N—dimethyl acetamide | | | | X |
| N,N—diethyl acetamide | | | | X |
| N,N—dimethyl propionamide | | | | X |
| N,N—dibutylformamide | | | | X |

TABLE I-continued

SOLVENT CROSS REFERENCE TO PERFLUOROCARBON COPOLYMER CONTAINING VARIOUS PENDANT FUNCTIONAL GROUPS

| SOLVENT | FUNCTIONAL GROUP | | | |
|---|---|---|---|---|
| | $SO_2F$ | $COO^-Z^+$ | COO (ester) | $SO_3^-Z^+$ |
| N,N—dipropylacetamide | | | | X |
| N,N—dimethyl formamide | | | | X |
| 1-methyl-2-pyrrolidinone | | | | X |
| diethylene glycol | | | | X |
| ethylacetamidoacetate | | | | X |

Z is any alkali or alkaline earth metal or a quaternary ammonium ion having attached hydrogen, alkyl, substituted alkyl, aromatic, or cyclic hydrocarbon.
Halocarbon oil is a commercially marketed oligomer of chlorotrifluoroethylene.

Certain of the solvating dispersion media function more effectively with perfluorocarbon having particular metal ions associated with the functional group. For example, N-butylacetamide functions well with the groups COOLi and $SO_3Ca$. Sulfolane and N,N-dipropylacetamide function well with $SO_3Na$ functionality.

It is believed that other suitable or conventional perhalogenated compounds can be used for at least partially solvating $SO_2F$ or carboxylate ester forms of perfluorocarbon copolymer. It is believed that other suitable or conventional strongly polar compounds can be used for solvating the ionic sulfonate and carboxylate forms of perfluorocarbon copolymer.

A composite electrode is formed by blending the conductive electrode materials with the dispersion. The blended dispersion is deposited, and the dispersion media is removed. Relatively finely divided electrode material remains at least partially coated sufficient to assure coadherence between the particles. Preferably this coating of finely divided electrode material is accomplished simultaneously with dispersion of the copolymeric perfluorocarbon.

In at least partially solvating the perfluorocarbon polymers, it is frequently found necessary to heat a blend of the dispersion media and the relatively finely divided perfluorocarbon to a temperature between about 50° C. and 250° C., but not in excess of the boiling point for the resulting dispersion. Depending upon the solvent, a solution of between about 5 and 25 weight percent results. It is not necessary that the perfluorocarbon be dissolved completely in order to form a suitable electrode composite. It is important that undissolved perfluorocarbon be in relatively small particles to avoid isolating relatively large amounts of the conductive electrode material within groupings of larger perfluorocarbon particles. One preferred technique comprises heating the dispersion to at least approach complete solvation and then cooling the dispersion to form a gelatinous dispersion having particles of approximately a desired size. The cooled temperature will vary with the solvent selected. The particle size is controllable using either of mechanical or ultrasonic disruption of the gelatinous dispersion.

Referring to Table I, it may be seen that various solvents have a particularly favorable effect upon only perfluorocarbon copolymers having certain functional groups. Where a composite electrode containing perfluorocarbon having funtional groups of a first type is to be at least partially solvent welded to a perfluorocarbon membrane having functional groups of a second type, conversion of one or both types of functional groups may be necessary to achieve solvent compatibility. Particularly, hydrolysis and substitution of metal ions ionically bonded to the functional group can provide a relatively simple tool for coordinating funtional groups and solvents. However, other methods such as the use of $SF_4$ to reform sulfonyl fluoride functional groups from derivatives of sulfonyl fluoride are also available.

The composite of the dispersion and the conductive electrode material are deposited as a sheet-like SPE electrode. This SPE electrode sheet generally has a length and breadth of considerably greater dimension than its thickness. Upon removal of the dispersion media, the SPE electrodes comprise composite SPE electrodes 16, 17 of the perfluorocarbon copolymer and the conductive electrode material applied to the separator 15. Dispersion media removal can be accompanied by heating, vacuum, or both, with temperatures of between 80° C. and 250° C. being preferred. Alternately dispersion media can be extracted using a leaching agent substantially miscible in the dispersion media.

The dispersion, including the coated electrode material, can be deposited separately from the membrane 15, and subsequently the resulting composite SPE electrode attached or coadhered to the membrane. Alternately the dispersion can be deposited directly upon the separator 15. In either alternate, after forming into an SPE electrode sheet, removal of most or all of the dispersion media is effected.

Where the SPE electrode sheet has been deposited separately from the separator 15, upon removal of at least most of the dispersion media, the resulting composite SPE electrode 16, 17 can be heated gently and pressed into the separator or membrane until firmly coadhering thereto. Generally a temperature of between 50° C. and 250° C. accompanied by application of between about 500 and 4000 pounds per square inch pressure will suffice to coadhere the composite SPE electrode 16,17 and the separator. Where relatively finely divided metallic electrode material has been utilized in preparing the SPE electrode, the pressure need not be applied simultaneous over the entire SPE electrode to effectuate coadherence, but bubbles should be avoided.

From time to time a partially solvating dispersion media compatible with the perfluorocarbon copolymer used in preparation of the composite SPE electrode 16,17 is also compatible with the perfluorocarbon copolymer present at the surface of the separator 15 to which the composite SPE electrode 16,17 is to be coadhered or to surfaces where functional groups can be readily modified to be compatible. Composite SPE electrodes prepared using this dually compatible dispersion media can be deposited directly upon the separator surface and the dispersion media removed by suitable or conventional methods. Prior to removal, the solvating dispersion media promotes coadherence between the perfluorocarbon copolymeric composite SPE electrode and the perfluorocarbon copolymeric separator. Exposure to heat within 50° C. and 250° C. and/or pressure between 500 to 4000 pounds enhances this coadherence when the heat and/or pressure are applied either simultaneous to or subsequent to removal of the dispersion media. Where solvent compatibility does not exist, direct deposition upon the membrane is possible, but heat and pressure will be required for coadherence.

When using a relatively finely divided metallic electrode material in preparing a composite SPE electrode, it is preferable to include a plurality of pores in the final composite SPE electrode to facilitate movement of cell chemistry such as brine, caustic, and gaseous chlorine or hydrogen to and from the conductive electrode material. Such pores can be created by the inclusion of a pore precursor in the dispersion of copolymeric perfluorocarbon prior to deposition of the dispersion. Subsequent to removal of the dispersion media, the pore precursor is removed from the SPE electrode in any suitable or conventional manner such as by immersing a completed SPE electrode in a solution capable of solvating the pore precursor without damaging the perfluorocarbon copolymer or the metallic electrode material of the composite.

In FIG. 1, anode pores 42 are shown in the composite SPE anode 16, and cathode pores 44 are shown in the composite SPE cathode 17.

In one alternate of the best embodiment for producing chlorine from sodium chloride brine, the metallic electrode material for the SPE anode 16 is relatively finely divided ruthenium oxide 47 and the metallic electrode material for the SPE cathode 17 is comprised of relatively finely divided platinum and carbon 49. In such composite SPE electrodes, the pore precursor included in the dispersion can be zinc oxide. Advantageously, the zinc oxide pore precursor can be removed from completed SPE electrodes either before or after coadherence to the membrane. Removal of the pore precursor is effected with a strongly alkaline substance such as caustic, KOH or the like. The strongly alkali solution also performs to hydrolyze sulfonyl fluoride and methyl carboxylate pendant functional groups in intermediate copolymeric perfluorocarbon to active ion exchange sites. Hydrolysis readies the perfluorocarbon for use in the electrochemical cell.

In an equally preferred alternate, certain solvents can be used to provide pores within the SPE electrode. Particularly, perfluorooctanoic and perfluorodecanoic acids are available to form pores. After dissolution or partial dissolution of perfluorocarbon in these solvents at elevated temperatures, the solution is cooled until a gel begins to form. As the gel forms, syneresis of excess dispersion media occurs from the gel. As cooling continues, these synerizing solvents form droplets within the gel which crystallize. After deposition of the SPE electrode, the deposited SPE electrode is hydrolyzed by saponification with strong caustic or the like. Crystallized droplets are then extracted using a compatible solvent such as FREON 113 or the like to produce the pores. Using a leaching agent like FREON 113 both crystallized and noncrystallized dispersion media can equally be extracted cocurrently. Advantageously, these crystallized droplets tend to migrate to the surface leaving tracks enhancing porosity. Alternately the crystallized solvent can be sublimed at a temperature below its melting point.

An SPE having an entrained gas release particulate is fabricated in a like manner except using the appropriate gas release particulate in formulating the dispersion. SPE's containing this entrained gas release particulate exhibit far less chalking and sloughing of the particulate than do SPE's formed by pressing of the particulate into the perfluorocarbon.

Particularly for membranes having a fabric reinforcing mesh, the surface of the membrane often resembles a dimpled or checkerboard surface of ridges and valleys. Formation of a separate SPE sheet and subsequent pressing onto the membrane of the separate SPE sheet can avoid pooling of dispersion in the checkerboard surface of the membrane that would produce substantial variation in thickness of the SPE layer. Pressing preferably is accomplished here using a resilient, relatively readily compressible backing between press and SPE to assist in conforming the SPE to contours of the membrane surface. A fibrous board functions well for this surface and materials subject to cold flowing are preferably avoided as a backing material for this service.

The SPE particulate dispersion can also be sprayed upon the membrane using added diluents having a relatively low boiling point so that they may be at least partially removed to thicken the dispersion upon the membrane to forestall drips, sags, and the like.

The following examples are offered to further illustrate the invention.

EXAMPLE I

A solid polymer electrolyte cathode was prepared by first forming a dispersion at room temperature between:

- 0.30 grams nickel powder
- 0.09 grams ZnO
- 0.06 grams graphite
- 75 drops of 1.5 percent (weight) solution of an 1100 equivalent weight NAFION copolymer having pendant $SO_2F$ functional groups in Fluorinert FC-70, a perfluorotrialkylamine, available from 3M Co., dispersed at 210° C. and cooled to room temperature.

The dispersion was spread over a 3 square inch aluminum foil surface and dried at 120° C. The deposited electrode was then pressed at 150° C. and 1000 psi pressure for 20 minutes into 10/950/COOH film (read as 10 mils thick, 950 gram equivalent weight NAFION copolymeric film having pendant COOH groups). The foil and zinc oxide were digested with NaOH and the resulting solid polymer electrolyte electrode assembly was further saponified with a 13 percent KOH solution for 16 hours at room temperature. The SPE electrode was then exposed to 150 grams per liter NaOH for 24 hours at room temperature.

The SPE-electrode was then installed in a lab scale electrolytic cell with the copolymeric film opposing a 3 square inch anode having a dimensionally stable anode coating like Diamond Shamrock CX and a nickel screen current collector in contact with the SPE. The bench scale cell was configured whereby the film divided the cell in liquid sealing relationship defining anode and cathode compartments. Brines varying in concentration between 280 and 300 grams NaCl per liter were introduced into the anode compartment. Water flow to the cathode compartment was regulated to maintain between 410 grams per liter and 460 grams per liter caustic. Six amperes was impressed between anode and cathode. Caustic current efficiency ranged between 90 percent and 94 percent. Cell voltage varied between 3.3 and 3.5 volts.

EXAMPLE II

An SPE anode assembly was prepared at room temperature by first blending:

0.03 grams $RuO_2$ 0.015 gram ZnO 1 drop 5 percent by weight of a dispersed 950 equivalent weight copolymeric perfluorocarbon having pendant $COO^-Li^+$ functional groups in N-butylacetamide, dispersed at 100° C. and cooled to room temperature.

The blended dispersion was applied to a one inch square of a less than 10 mil thickness of 950 equivalent weight copolymeric perfluorocarbon film having pendant COOH functional groups. The dispersion media, N-butylacetamide was removed by heating at 120° C. for 10 minutes, the anode assembly was soaked in 2 percent HCl for 10 minutes and 150 grams per liter NaOH for 10 minutes, then washed with water.

EXAMPLE III

An SPE cathode assembly was prepared at room temperature by blending:

0.10 grams nickel powder 0.03 grams zinc oxide 0.02 grams graphite 2 drops of 5 percent by weight dispersion of 950/$COO^-Li^+$ and N-butylacetamide prepared as in Example II.

The blended dispersion was applied to a 1 square inch aluminum foil surface and then dried at 120° C. The resulting SPE cathode was applied to a less than 10 mil thickness of 950 equivalent weight COOH film using 2000 psig at 110° C. for 5 minutes. The foil and ZnO were dissolved using NaOH.

EXAMPLE IV

N-butylacetamide and about 14 percent by weight of a 950 gram equivalent weight copolymeric perfluorocarbon having pendant $COO^-Li^+$ functional groups were blended at approximately 200° C. The resulting solution was clear. When cooled to room temperature, the dispersion, while remaining clear, became quite viscous. Where 5 percent by weight of the perfluorocarbon is added to the N-butylacetamide dispersion media and heated to 100° C., subsequent cooling to room temperature results in a clear, freely flowing gelatinous dispersion.

EXAMPLE V

Solid polymeric electrolyte electrodes were prepared for cell testing in accordance with Example I except utilizing:

0.3 grams nickel powder 0.09 grams ZnO 0.06 grams graphite 90 drops of the gelatinous dispersion of Example I Cell testing produced results substantially equal to those in Example I.

EXAMPLE VI 5.0 grams of duPont NAFION 511 catalyst having an equivalent weight of 1100 and having a pendant functionality comprising $RSO_3Li$ was dispersed in SULFOLANE to form a 10% weight dispersion. 4.5 grams of titanium dioxide (duPont R-101, 0.3 microns, dried for 16 hours at 50° C.) was added to the dispersion which was then agitated at high speed for 5–10 minutes. The resulting dispersion was cast on a 1 mil thickness of aluminum foil using a Gardner knife.

The SULFOLANE was then partially removed using radiant heat and the resulting sheet SPE was dried in forced air at 130° C. for 24 hours. A 1 mil thick perfluorocarbon casting having entrained titanium dioxide resulted. The SPE was press laminated to a sheet of NAFION 117 film having pendant functional groups of the form $RSO_3Li$ using a PASEDENA at 2,000 pounds per square inch.

The aluminum foil was then dissolved from the SPE in 150 gram per liter NaOH to leave a membrane having an attached solid polymer electrolyte (SPE) of a thickness of between 0.5 and 0.75 mils.

EXAMPLE VII

A dispersion was prepared in accordance with Example VI. The dispersion was sprayed using an air sprayer onto four substrates: a 1 mil thickness of aluminum foil; a 1 mil thickness of anodized aluminum foil; a sheet of cellophane; and a mesh reinforced perfluorocarbon copolymer membrane (duPont Nafion 901), the membrane perfluorocarbon having pendant $RSO_3Li$ and $RCO_2Li$ pendant functionality, and being approximately 10 mils in thickness. The applied dispersions were force air dried at 130° C. for 16–24 hours to yield solid polymer electrolytes. The SPE's applied to aluminum foil were transferred to membranes in accordance with Example VI, producing substantially similar results. Likewise, the SPE applied to cellophane was transferred to a membrane in accordance with Example VI excepting the cellophane being peeled away from the SPE subsequent to the transfer operation. When pressing these SPE's to their respective membranes at 2,000 pounds per square inch, a section of cardboard was introduced between each press platen and the SPE's. These SPE's applied to the reinforced perfluorocarbon copolymeric membrane was found to be tightly adhered.

EXAMPLE VIII

DuPont R-101 titanium dioxide powder was sprinkled on to a perfluorocarbon copolymeric film (NAFION 115) and then pressed into the perfluorocarbon copolymeric film using a hydraulic flat press. Pressing was conducted at 350° F. at 4,000 pounds per square inch for 30 minutes; and upon completion of pressing substantial sloughing of $TiO_2$ powder from the surface of the membrane was observed, leaving a chalky membrane surface. From observation it was readily apparent that titanium dioxide powder applied in accordance with Examples VI and VII was substantially better adhered to a membrane than when applied in accordance with this example.

EXAMPLE IX

Nine parts of titanium dioxide 3 micron powder, 10 parts of a 10 weight percent dispersion of the perfluorocarbon of Example VI in SULFOLANE, and 21 parts of isopropanol were blended at high speed. The resulting dispersion was poured into a glass dish and swirled to cover the bottom evenly. A foam rubber roller was rolled in the dish to achieve uniform coverage on the roller and then passed several times across a sheet of aluminum foil to produce a uniform thin coating. The coating on the foil sheet was then dried in a forced air oven at 150° C. for 18 hours. Two 5 inch×5 inch squares were cut from the solid polymer electrolyte that resulted. These squares were laminated to 4 inch×4 inch pieces of mesh reinforced perfluorocarbon copolymeric 10 mil film (duPont Nafion 901) by hydraulic pressing at 350° F. at 3,000 pounds per square inch for 30 minutes using a sheet of aluminum foil covered cardboard between the press plate and the SPE being pressed into the film. A membrane having a tightly adhered SPE resulted.

EXAMPLE X

The method of Example IX was repeated using zirconium oxide (available from Fisher Scientific) with substantially identical results.

EXAMPLE XI

The method of Example IX was repeated except that the ratio of the dispersion components was changed to include 9 parts zirconium oxide, 10 parts of a 10 weight percent dispersion of the perfluorocarbon copolymer of Example VI in SULFOLANE and 81 parts isopropanol. The resulting SPE had a substantially similar appearance to that of Example X excepting that the resulting SPE was slightly thicker.

EXAMPLE XII

The dispersion of titanium dioxide, perfluorocarbon copolymer in SULFOLANE, and isopropanol of Example IX was rolled directly onto a mesh reinforced perfluorocarbon copolymeric film (duPont Nafion 901) of approximately 10 mils in thickness. Coating was accomplished by resting a 4 inch by 4 inch piece of the reinforced membrane on a vacuum assisted table with the surface having pendant sulfonate functionality facing up. The roller was passed three times over the surface of the film giving a thin uniform coating which dried quite quickly. The film was then flipped over and the ridged side wherein the pattern of the reinforcing mesh could be clearly distinguished was similarly coated. The film was then dried in a forced air oven at 150° C. for 18 hours and then pressed at 350° F. and 3,000 pounds per square inch for 30 minutes with a piece of aluminum foil covered cardboard being interposed between press plates and the coated reinforced perfluorocarbon copolymeric film. A smooth, uniform and thin SPE resulted tightly bonded to the copolymeric membrane.

EXAMPLE XIII

The method of Example XII was repeated except using zirconium oxide in lieu of titanium dioxide. After pressing the resulting coadhered SPE was substantially the same as that of Example XII.

While a preferred embodiment of the invention has been described in detail, it will be apparent that various modifications or alterations may be made therein without departing from the spirit and scope of the invention as set forth in the appended claims.

What is claimed is:

1. A solid polymer electrolyte electrode assembly comprising:

a perfluorocarbon copolymeric membrane comprising two zones each having functional groups with the groups differing from one zone to the other;

a hydrophylic perfluorocarbon copolymer composite anode prepared from a dispersion of conductive particulate substance and hydrophylic perfluorocarbon copolymer dispersed in solvating dispersion medium, said anode being coadhered to one membrane surface and consisting essentially of said conductive particulate substance partially coated with the hydrophylic perfluorocarbon copolymer, said copolymer having equivalent weight between about 900 and 1500; and a hydrophylic perfluorocarbon copolymer composite cathode prepared from a dispersion of particulate electrocatalytic compound and hydrophylic perfluorocarbon copolymer dispersed in solvating dispersion medium, said cathode being coadhered to the surface of the membrane obverse from said anode, said cathode consisting essentially of said particulate electrocatalytic compound partially coated with the hydrophylic perfluorocarbon copolymer, said copolymer having equivalent weight between about 900 and 1500.

2. The assembly of claim 1 wherein said membrane comprises one zone of copolymeric perfluorocarbon containing pendant sulfonyl based functional groups and a second zone of copolymeric perfluorocarbon containing pendant carbonyl based functional groups.

* * * * *